US011225783B2

(12) United States Patent
Armbruster et al.

(10) Patent No.: US 11,225,783 B2
(45) Date of Patent: Jan. 18, 2022

(54) WASHING PLACE ARRANGEMENT

(71) Applicant: Hansgrohe SE, Schiltach (DE)

(72) Inventors: Stefan Armbruster, Hausach (DE); Marco Flaig, Stuttgart (DE); Axel Meißner, Offenburg (DE); Matthias Oesterle, Winterbach (DE)

(73) Assignee: Hansgrohe SE, Schiltach (DE)

( * ) Notice: Subject to any disclaimer, the term of this patent is extended or adjusted under 35 U.S.C. 154(b) by 44 days.

(21) Appl. No.: 16/812,207

(22) Filed: Mar. 6, 2020

(65) Prior Publication Data

US 2020/0284002 A1 Sep. 10, 2020

(30) Foreign Application Priority Data

Mar. 8, 2019 (DE) ..... 10 2019 203 168.4

(51) Int. Cl.
*E03C 1/048* (2006.01)
*E03C 1/04* (2006.01)
(Continued)

(52) U.S. Cl.
CPC ..... *E03C 1/048* (2013.01); *E03C 1/0405* (2013.01); *E03C 1/08* (2013.01); *E03C 1/18* (2013.01)

(58) Field of Classification Search
CPC ..... E03C 1/048; E03C 1/0405; E03C 1/08; E03C 1/18
(Continued)

(56) References Cited

U.S. PATENT DOCUMENTS 624,176 A 5/1899 Chisholm
4,231,133 A 11/1980 Probost
(Continued)

FOREIGN PATENT DOCUMENTS

CN 206815448 U 12/2017
CN 107989130 A 5/2018
(Continued)

OTHER PUBLICATIONS

First Office Action issued by the National Intellectual Property Administration, P.R. China, dated Dec. 7, 2020 for Chinese Patent Application No. 202010151795.1 (in Chinese language with English translation), 19 pages.
(Continued)

*Primary Examiner* — Tuan N Nguyen
(74) *Attorney, Agent, or Firm* — Bose McKinney & Evans LLP

(57) ABSTRACT

A washing place arrangement including a washstand having a wash-bowl sink, a first water discharge device, including a plurality of water discharge nozzles arranged in the wash-bowl sink and configured for discharging water in a fountain jet which issues in an arc shape up to a maximum height and returns to the wash-bowl sink, and a second water discharge device discharging water in a shower jet. A nozzle assignment region of the first water discharge device is located in a rear half of the wash-bowl sink and extends across at most half the sink circumference. A shower jet outlet body of the second water discharge device is located on a rear side of the wash-bowl sink and the washstand and above the wash-bowl sink and the washstand. The second water discharge device is configured for discharging the shower jet in a direction pointing obliquely to the front downwards.

12 Claims, 4 Drawing Sheets

(51) Int. Cl.
*E03C 1/08* (2006.01)
*E03C 1/18* (2006.01)

(58) Field of Classification Search
USPC ..... 4/675
See application file for complete search history.

(56) References Cited

U.S. PATENT DOCUMENTS

| | | | |
|---|---|---|---|
| 7,155,759 | B2 | 1/2007 | Milne |
| 7,305,722 | B2 | 12/2007 | Sha et al. |
| 7,461,419 | B2 | 12/2008 | Milne |
| 9,228,330 | B1 | 1/2016 | Brown et al. |
| 2004/0194208 | A1 | 10/2004 | Milne |
| 2007/0123857 | A1 | 5/2007 | Deffenbaugh et al. |
| 2008/0005833 | A1 | 1/2008 | Bayley et al. |
| 2017/0254055 | A1* | 9/2017 | Xia ..... E03C 1/18 |
| 2018/0178225 | A1 | 6/2018 | Butzke et al. |

FOREIGN PATENT DOCUMENTS

| | | | |
|---|---|---|---|
| DE | 200 21 035 | U1 | 4/2002 |
| DE | 102016225987 | A1 | 6/2018 |
| EP | 2108749 | A2 | 10/2009 |
| JP | 2001292920 | A | 10/2001 |
| JP | 2007069024 | A | 3/2007 |
| TW | 200712292 | A | 4/2007 |

OTHER PUBLICATIONS

Office Action in German Language issued by the German Patent Office, Munich, Germany, dated Feb. 7, 2020, for German Patent Application No. 10 2019 203 168.4.

Russian Decision to Grant for Application No. 2020109565/03(015780) dated Jul. 28, 2020, 12 pages.

* cited by examiner

WASHING PLACE ARRANGEMENT

CROSS-REFERENCE TO RELATED APPLICATION

This application claims priority to German Patent Application No. DE 10 2019 203 168.4, filed on Mar. 8, 2019, the disclosure of which is expressly incorporated herein by reference.

BACKGROUND AND SUMMARY OF THE DISCLOSURE

The invention relates to a washing place arrangement including a washstand having a wash-bowl sink, a first water discharge device including a plurality of water discharge nozzles arranged within a nozzle assignment region in the wash-bowl sink and configured for discharging water in the form of a fountain jet which issues in an arc form upward from the wash-bowl sink with an upward portion up to a maximum height and returns downward to the wash-bowl sink with a downward portion, and a second water discharge device configured for discharging water in the form of a shower jet and having a shower jet outlet body. The washing place arrangement may for example be situated in a bathroom. At the washstand, the user may wash or perform various other bodily care measures.

A washing place arrangement of the type cited initially is disclosed in patent publications U.S. Pat. No. 7,155,759 B2 and U.S. Pat. No. 7,461,419 B2. In the washing place arrangement disclosed therein, the water discharge nozzles for discharging the fountain jet are formed by water discharge openings in the wash-bowl sink which are arranged in a preferably irregular pattern over the entire sink, or in any case in an upper region of the sink, over the entire circumference of the sink. The water discharge nozzles with their associated individual jet devices are all oriented towards a central region of the wash-bowl sink so as to give a cupola-shaped fountain jet. With respect to a front side of the washstand facing the user, i.e. the front side is in this case defined as the side on which the user normally stands for correct usage when he wishes to use the washing place arrangement, the second water discharge device in the form of a hand shower is arranged in a side region of the washstand at the side next to the wash-bowl sink, is preferably connected to a flexible hose and has a ball-shaped shower jet outlet body which is configured to provide a high-speed shower jet.

It is an object of the invention to provide a washing place arrangement of the type cited initially which offers significant advantages over the above-mentioned prior art, in particular with respect to its water discharge properties and its possible applications and application properties.

The illustrative embodiment of the invention achieves this and other objects by providing a washing place arrangement including a washstand having a wash-bowl sink, a first water discharge device, including a plurality of water discharge nozzles arranged within a nozzle assignment region in the wash-bowl sink and configured for discharging water in the form of a fountain jet which issues in an arc shape with an up section from the wash-bowl sink upwards up to a maximum height and returns to the wash-bowl sink downwards with a down section, and a second water discharge device, configured for discharging water in the form of a shower jet and including a shower jet outlet body. The nozzle assignment region of the first water discharge device is located in a rear half of the wash-bowl sink facing away from a user side and extending across at most half the sink circumference. The shower jet outlet body of the second water discharge device is located on a rear side of the wash-bowl sink and the washstand facing away from the user side and at a height above the wash-bowl sink and the washstand, wherein the second water discharge device is configured for discharging the shower jet in a shower jet direction pointing obliquely downwards towards the front.

This special combination of the two water discharge devices, and the resulting special combination of a specific fountain jet and a specific shower jet with shower jet direction pointing obliquely downwards towards the front, give the washing place arrangement according to the invention extremely advantageous water discharge properties for many applications. The special positioning of the nozzle assignment region of the first water discharge device in the rear half of the wash-bowl sink facing away from a user side, and the limited extension of this nozzle assignment region over at most half the sink circumference, allow the first water discharge device to provide a relatively targeted and/or well bundled fountain jet in the direction of the front of the wash-bowl sink and washstand facing towards the user. In particular, by means of this nozzle assignment region or the water discharge nozzles arranged therein, the fountain jet can be provided with jet direction components pointing towards the user. The nozzle assignment region is preferably formed by a strip-like sink region with greater extent, i.e. longer strip length, in the sink circumferential direction and shorter extent, i.e. smaller strip width, perpendicular thereto. In comparison with said conventional, cupola-like fountain jet, in the present case the fountain jet may provide a water flow which is more localised over its jet course and leaves larger regions of the wash-bowl sink free, so that the user does not become unnecessarily or undesirably wet while acting in this region. In the water-assigned region, the fountain jet may have a relatively dense water flow over its jet course, which the user can effectively use for the respective application. The fountain jet differs from a conventional torrent jet, and other conventional water discharge jets using outlet fittings with an outlet pipe ending above the sink, by its course directed obliquely upward and then obliquely downward in a parabola form, and by its composition of a multiplicity of individual jets emitted by the water discharge nozzles.

As required, the first and second water discharge devices may be activated individually or together, i.e. the user has the option of using for his application only the fountain jet, only the shower jet or both jets combined, and using the respective optimised jet type for his various applications such as washing hands, face washing, cleaning teeth, filling beakers or similar with water, washing or rinsing objects, washing hair, beard cleaning etc. Since, in the present washing place arrangement, no water outlet pipe over the wash-bowl sink is absolutely required, the user has unhindered space over the wash-bowl sink for his washing applications, e.g. for the head when washing hair or cleaning a beard.

In an illustrative refinement of the invention, the first and the second water discharge devices are configured such that the shower jet strikes the fountain jet in the latter's upward portion when both water discharge devices are active. This provides a configuration of the two water discharge devices which is favourable for many applications, either for applications in which only the fountain jet or only the shower jet is active, or in applications in which the fountain jet and shower jet are active in combination.

In an illustrative refinement of the invention, the first and the second water discharge devices are configured such that the shower jet strikes the fountain jet at a height that is at least a quarter of the maximum height of the fountain jet above the wash-bowl sink when both water discharge devices are active. This again constitutes a configuration of the two water discharge devices which is advantageous for many applications. In advantageous embodiments, the shower jet strikes the fountain jet at a height which amounts to at least a third or at least half the maximum height of the fountain jet above the wash-bowl sink. In alternative embodiments, the shower jet strikes the fountain jet at a height which is less than a quarter of the maximum height of the fountain jet above the wash-bowl sink. In further alternative embodiments, the shower jet strikes the fountain jet in its downward portion or does not strike the fountain jet but forms a separate shower jet which is not combined with the fountain jet.

In an illustrative refinement of the invention, the height level of the shower jet outlet body of the second water discharge device is located at or above half the maximum height of the fountain jet above the wash-bowl sink. In this way, the shower jet can be provided for use at a correspondingly great height, either alone or in combination with the fountain jet which is active simultaneously.

In an illustrative refinement of the invention, the water discharge nozzles of the first water discharge device are misting/fine jet nozzles. Here, in particular special misting/fine jet nozzles may be used such as the shower devices sold by the applicant under the trade name PowderRain and as disclosed in laid-open publication DE 10 2016 225 987 A1 by the applicant. In alternative illustrative embodiments, the water discharge nozzles are formed by other conventional nozzles which are also normally used in showerheads.

In an illustrative refinement of the invention, the shower jet outlet body of the second water discharge device comprises a plurality of fine/needle jet nozzles. These may in particular be the fine jet nozzles or needle jet nozzles known to the person skilled in the art for use in showerheads. Alternatively, the misting/fine jet nozzles may take the form of the PowderRain nozzles by the applicant, or conventional standard jet nozzles, or a torrent jet nozzle as known to the person skilled in the art for use in showerheads.

In an illustrative refinement of the invention, the washing place arrangement has a wall-mounted accommodation body in which the shower jet outlet body is accommodated. A fitting or accommodation body to be mounted at or on the washstand for accommodating the shower jet outlet body may therefore be omitted. In alternative embodiments, such a washstand-mounted accommodation body may be provided for the shower jet outlet body.

In an illustrative embodiment of the invention, the accommodation body is a placement body having a placement surface on the top side. In this way, the accommodation body may fulfil a placement function in addition to its function of accommodating the shower jet outlet body. Washing utensils or similar, which are usually required on the washing place arrangement, may be placed on the placement surface.

In one illustrative embodiment of the invention, the washing place arrangement has a wall-mounted mirror, wherein the accommodation body is located, at least with a portion containing the shower jet outlet body, in front of the mirror and adjoins the mirror. In this way, the presence of a rear mirror, normally desired for a washing place arrangement, can advantageously be combined in a technically functional fashion with the accommodation or holding of the shower jet outlet body.

In an illustrative refinement of the invention, the washing place arrangement comprises a further third water discharge device which is configured for discharging water in the form of a laminar jet in a laminar jet direction pointing obliquely downwards towards the front, and comprises a laminar jet outlet body. This expands the functionality of the washing place arrangement by the capacity to discharge water into the wash-bowl sink when required as a laminar jet, either individually or in combination with the shower jet or in combination with the fountain jet or in combination with the shower jet and the fountain jet.

In one illustrative embodiment of the invention, an angle difference between the laminar jet direction and the shower jet direction is at most 15°. This means that the laminar jet direction and the shower jet direction may be established as required parallel to each other or differing from each other only by a relatively slight differential angle. This may be advantageously used for specific applications.

In one illustrative embodiment of the invention, the laminar jet outlet body is accommodated in the accommodation body. This means that the laminar jet outlet body and the shower jet outlet body are together accommodated in the accommodation body, which brings advantages with regard to compactness of construction of the washing place arrangement and with regard to installation space required, so that plenty of space remains available to the user for washing/cleaning applications in the region above the wash-bowl sink.

Additional features and advantages of the present invention will become apparent to those skilled in the art upon consideration of the following detailed description of the illustrative embodiments best exemplifying the best mode of carrying out the invention as presently perceived.

BRIEF DESCRIPTION OF THE DRAWINGS

Advantageous embodiments of the invention are illustrated in the drawings. These and further embodiments of the invention are described in greater detail below. In the drawings.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
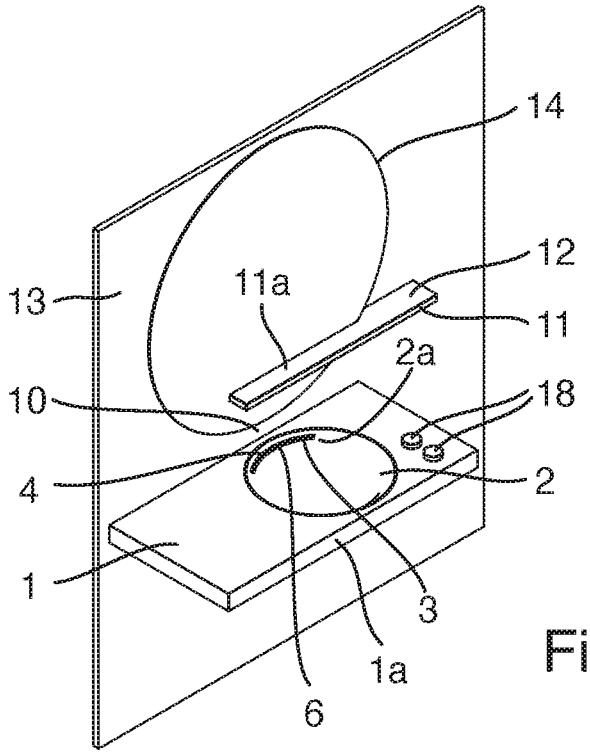
FIG. 1 shows a diagrammatic perspective view of a washing place arrangement, FIG. 2 a diagrammatic front view of the washing place arrangement from FIG. 1, FIG. 3 a diagrammatic top view from above onto the washing place arrangement from FIG. 1, FIG. 4 a sectional view along line IV-IV in FIG. 3, FIG. 5 a side view in extract of the washing place arrangement with activated fountain jet, FIG. 6 the view from FIG. 5 with activated shower jet, FIG. 7 the view from FIG. 5 with activated laminar jet, FIG. 8 the view from FIG. 5 with activated fountain jet, shower jet and laminar jet, and FIG. 9 a perspective view in extract according to FIG. 1 with activated fountain jet, shower jet and laminar jet.
Figure 2:
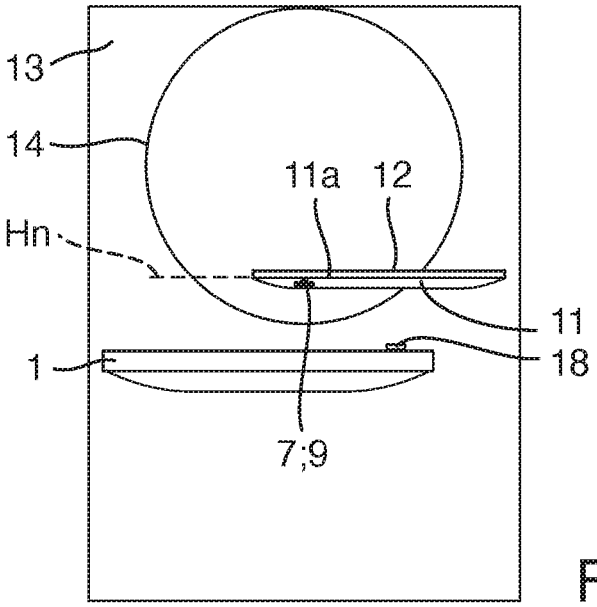
Figure 3:
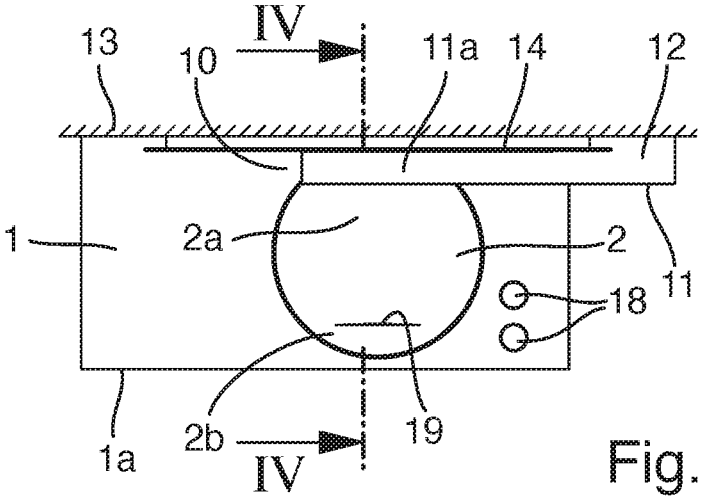
Figure 4:
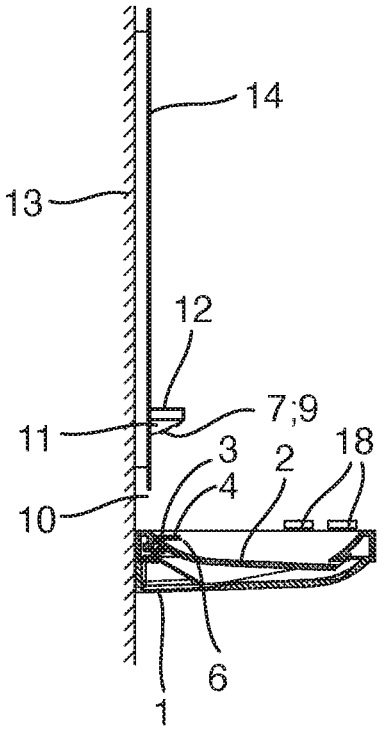
Figure 5:
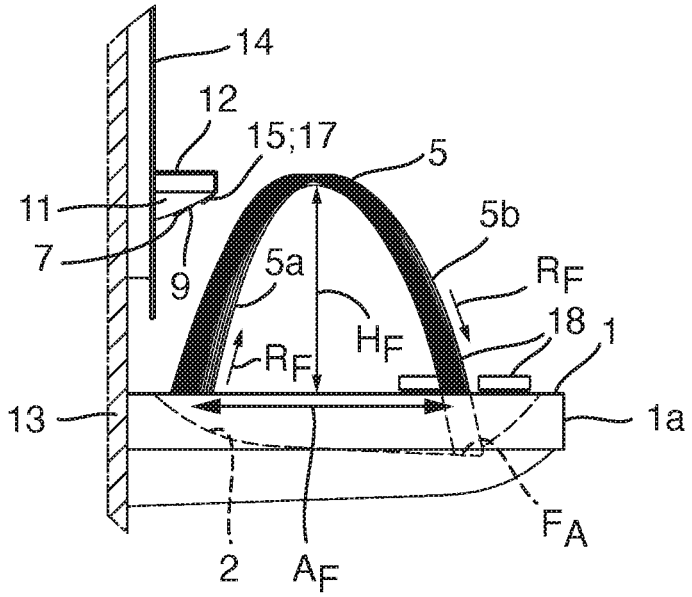
Figure 6:
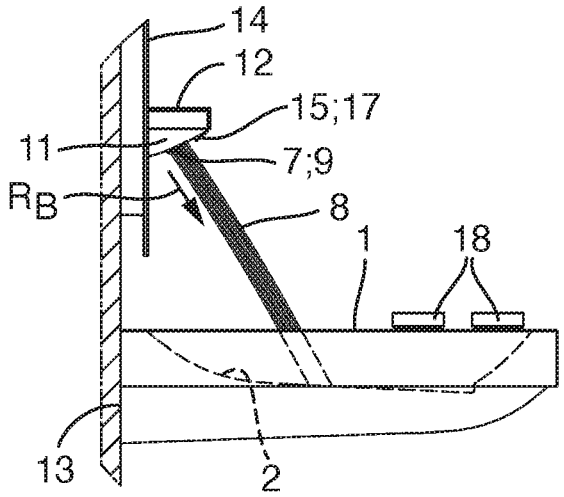
Figure 7:
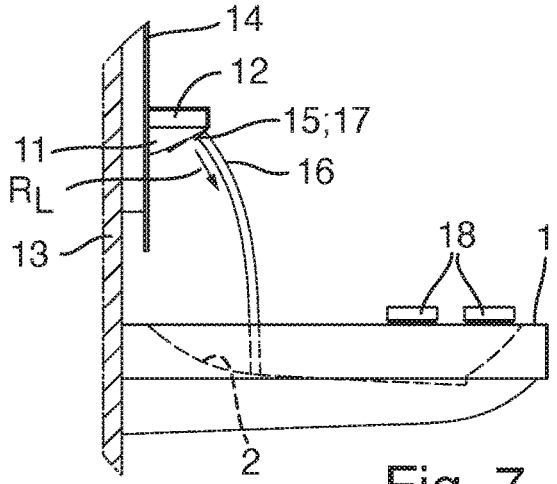

The washing place arrangement illustrated in the figures contains a washstand 1 with a wash-bowl sink 2, a first water discharge device 3 which has a plurality of water discharge nozzles 4 arranged inside a nozzle assignment region 6 in the wash-bowl sink 2 and configured to discharge water in the form of a fountain jet 5, and a second water discharge device 7 which is configured to discharge water in the form of a shower jet 8 and has a shower jet outlet body 9. The nozzle assignment region 6 of the first water discharge device 3 is situated in a rear half 2*a* of the wash-bowl sink 2 facing away from the user side, and extends at most over half the circumference of the wash-bowl sink 2. As evident in particular from FIGS. 5, 8 and 9, when the first water discharge device 3 is activated, the fountain jet 5 issues from the wash-bowl sink 2 in the form of an arc with an upward portion 5*a* directed upwards from the nozzle assignment region 6 or the water discharge nozzles 4, and then returns downwards into the wash-bowl sink 2 with a downward portion 5*b*.

The shower jet outlet body 9 of the second water discharge device 7 is situated on a rear 10 of the wash-bowl sink 2 and the washstand 1 facing away from the user side, and at a height Hn which lies above the wash-bowl sink 2 and the washstand 1. The second water discharge device 7 is configured to discharge the shower jet 8 in a shower jet direction RB pointing obliquely downwards towards the front.

The first water discharge device 3 is configured to discharge the fountain jet 5 in a fountain jet direction RF which, in the upward portion 5*a* of the fountain jet 5, points obliquely upwards towards the front and, in the downward portion 5*b* of the fountain jet 5, points obliquely downwards towards the front. In corresponding designs, the first water discharge device 3 is configured to generate the fountain jet 5 in the form of a fan-like parabola from individual jets of the water discharge nozzles 4, wherein the trajectory height i.e. the maximum height HF of the fountain jet 5 above the wash-bowl sink 2, amounts preferably to between 80% and 120% of the trajectory width of the fountain jet 5, i.e. a horizontal distance AF of a region FA, in which the fountain jet 5 strikes the wash-bowl sink 2 from the nozzle assignment region 6. In typical cases, this means a fountain jet height HF of between around 20 cm and around 40 cm above the sink 2. In advantageous embodiments, the water discharge nozzles 4 are configured as misting/fine jet nozzles of the PowderRain type.

In advantageous illustrative embodiments, the water discharge nozzles 4 are arranged in several nozzle groups succeeding each other in the sink circumferential direction, wherein the water discharge nozzles 4 of a respective nozzle group have the same jet outlet directions or directions which differ comparatively little from each other, while two water discharge nozzles of two adjacent nozzle groups differ from each other more greatly.

In the example shown, the water discharge nozzles 4 are specially arranged in three nozzle groups succeeding each other in the sink circumferential direction, wherein the water discharge nozzles 4 of a respective nozzle group have the same jet outlet directions, and the jet outlet directions of two lateral nozzle groups run angled by the same differential angular amount towards the jet outlet direction of a middle nozzle group. In particular, in this example the lateral jet strips are angled so as to converge towards the middle jet strip, and all three jet strips have practically the same trajectory height and width of their parabola-like arc form. The fountain jet 5 in its downward portion 5*b* retains a jet bundle form and/or a substantially constant jet width as far as its impact region FA on the sink 2.

This gives a fountain jet with a highly advantageous, symmetrical jet pattern in which the three jet strips of the three nozzle groups combine into a comparatively homogenous complete jet as the fountain jet 5. For this, in advantageous embodiments, the water discharge nozzles 4 are arranged in the wash-bowl sink 2 in a single row or a few rows inside the nozzle assignment region 6, which in this case is preferably formed as a strip. Optionally, the water discharge nozzles 4 of two adjacent rows may be offset to each other in the lateral, i.e. horizontal, direction, e.g. offset centrally.

Figure 8:
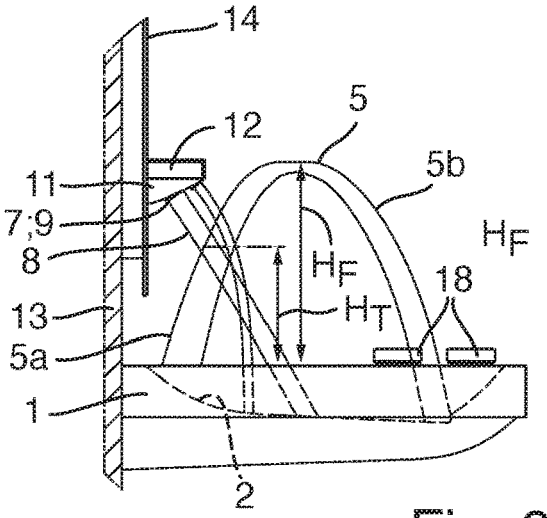
Figure 9:
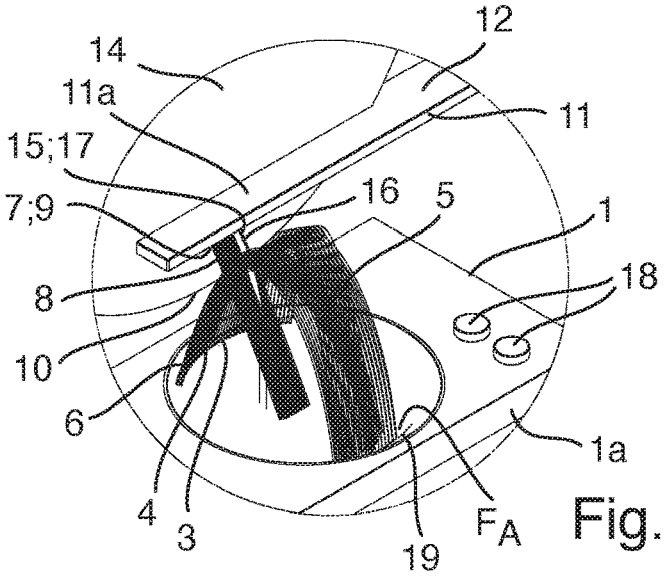

In corresponding illustrative embodiments, the first and the second water discharge devices 3, 7, as in the example shown, are configured such that the shower jet 8 strikes the fountain jet 5 in its upward portion 5*a*, as evident in particular from FIGS. 8 and 9.

In corresponding illustrative embodiments, as in the example shown, the first and second water discharge devices 3, 7 are configured such that the shower jet 8 strikes the fountain jet 5 at a height HT which amounts to at least a quarter of the total height HF of the fountain jet 5 above the wash-bowl sink 2. Advantageously, as in the example shown, this height HT is at least a third or at least half, and preferably between 55% and 75% of the total fountain jet height HF, which has proved particularly advantageous in many applications for an optimal jet behaviour of the combined water jet of the fountain jet 5 and shower jet 8, and for the separate use of the individually activated fountain jet 5 or shower jet 8.

In corresponding illustrative embodiments, the height level Hn at which the shower jet outlet body 9 of the second water discharge device 7 is arranged, as in the example shown, lies at or above half the total height HF of the fountain jet 5 above the wash-bowl sink 2. In corresponding embodiments, the shower jet outlet body 9 lies in height around the maximum height HF of the fountain jet 5 above the wash-bowl sink 2 or above, or at most only 20% below.

In advantageous illustrative embodiments, the shower jet outlet body 9 of the second water discharge device 7 contains a plurality of fine/needle jet nozzles, as known to the person skilled in the art for equipping corresponding shower bodies, e.g. as bores with comparatively small diameter in a correspondingly perforated metal plate. In alternative embodiments, the shower jet outlet body 9 is equipped with so-called standard jet nozzles or a torrent jet nozzle, as known to the person skilled in the art for fitting to showerheads in order to provide a standard shower jet.

In corresponding illustrative embodiments, as in the example shown, the washing place arrangement comprises a wall-mounted accommodation body 11 in which the shower jet outlet body 9 is accommodated. An associated wall surface 13 on the rear 10 of the washstand 1, on which the accommodation body 11 can be mounted and which forms a rear termination of the washing place arrangement, is indicated diagrammatically in the figures. Alternatively, the shower jet outlet body 9 may be situated in a water outlet fitting mounted on the washstand 1.

In corresponding illustrative embodiments, as in the example shown, the accommodation body 11 is configured as a placement body with a placement surface 12 on the top. Utensils which are typically used at a washing place arrangement can be laid on the placement surface 12 in the usual fashion.

In corresponding illustrative embodiments, as in the example shown, the washing place arrangement comprises a wall-mounted mirror 14, wherein the accommodation body 11 is located, at least with a portion 11*a* containing the shower jet outlet body 9, in front of the mirror 14 and adjoins the mirror 14.

In advantageous illustrative embodiments, as in the example shown, the washing place arrangement has a third water discharge device 15 which is configured to discharge water in the form of a laminar jet 16 in a laminar jet direction RL pointing obliquely downwards towards the front, and has a laminar jet outlet body 17. Such water discharge devices and associated laminar jet outlet bodies are well known to the person skilled in the art, e.g. from outlet fittings which have a tubular water outlet as a laminar jet outlet body that typically is provided with a jet regulator, perlator, particle screen or similar on the end, and therefore requires no further explanation.

In corresponding illustrative embodiments, as in the example shown, an angle difference between the laminar jet direction RL of the laminar jet 16 and the shower jet direction RB of the shower jet 8 amounts to maximum 15°. In corresponding embodiments, the laminar jet direction RL and the shower jet direction RB are identical or differ from each other at most by only a few angular degrees, of e.g. maximum 5°.

In corresponding illustrative embodiments, as in the example shown, the laminar jet outlet body 17 is arranged offset in the forward direction relative to the shower jet outlet body 9, i.e. towards the front side 1*a* of the washstand 1 facing the user, wherein—as in the example shown—at the same time it may also be arranged slightly offset in the vertical direction. The horizontal and/or vertical offset is relatively slight and in advantageous embodiments amounts at most to between 3 cm and 6 cm. In advantageous embodiments, as in the example shown, the shower jet outlet body 9 and the laminar jet outlet body 17 are arranged together in the same accommodation body 11. In alternative embodiments, the shower jet outlet body 9 and the laminar jet outlet body 17 are accommodated in different accommodation bodies.

In corresponding illustrative embodiments, as in the example shown, the wash-bowl sink 2 has a water drain 19 situated in a region 2*b* of the sink 2 facing the user side, and e.g. in the form of a slot with slot longitudinal axis parallel to a front side 1*a* of the washstand facing the user. In advantageous embodiments, the water drain 19 lies in the fountain jet impact region FA of the sink 2 or slightly in front of this, i.e. between the fountain jet impact region FA and the front termination of the sink 2 facing the washstand front side 1*a*.

In advantageous illustrative embodiments, for the first and second water discharge devices 3, 7 and for the optional third water discharge device 15, in a conventional manner, and therefore not shown, electrically actuatable valves are provided in order to regulate the water flow and water temperature of the water supplied to the respective water discharge device 3, 7, 15. An also conventional control unit, therefore not shown in more detail, is assigned to these valves. In corresponding embodiments, as in the example shown, remote-control operating elements 18 are provided as operating elements which can be operated by the user to adjust the water flow and/or the water temperature, wherein these operating elements 18 are configured as freely movable, puck-like operating elements which can be positioned at any point, e.g. on the top side of the washstand 1 outside the wash-bowl sink 2 as shown, and moved or displaced there freely. Alternatively, conventional manually operated elements and valves for the water discharge devices 3, 7, 15 may be used, such as manually operated shut-off, mixer or changeover valves, e.g. in the form of valves or fittings actuated by rotary knob or lever.

As the exemplary embodiments shown and explained above clearly illustrate, the invention provides a washing place arrangement with clear advantages for the user. The water may be provided either as a fountain jet and/or a shower jet and/or optionally also as a laminar jet at the washing place or above the wash-bowl sink 2. Conventional plumbing outlet fittings with an outlet pipe ending above the sink may be omitted. This has advantages for the usability of the washing place arrangement, since no regard need be taken of an outlet pipe of an outlet fitting. The combination of fountain jet and shower jet and optional laminar jet offers advantages in particular e.g. for washing hair and washing beards at the washing place over the wash-bowl sink.

Also, the washstand as a whole may be formed with a very flat surface which can significantly facilitate cleaning of the washstand arrangement. In particular, in corresponding embodiments, the wash-bowl sink may transform seamlessly and/or steplessly into the adjacent flat region of the washstand. Also, the absence of an outlet fitting typically mounted on the washstand in the region of the wash-bowl sink, with outlet pipe ending above the sink, facilitates cleaning of the washstand arrangement.

Although the invention has been described in detailed with reference to preferred embodiments, variations and modifications exist within the spirit and scope of the invention as described and defined in the following claims.

The invention claimed is:

1. A washing place arrangement comprising:

a washstand having a wash-bowl sink;

a first water discharge device comprising a plurality of water discharge nozzles arranged within a nozzle assignment region in the wash-bowl sink and configured for discharging water in the form of a fountain jet which issues in an arc shape with an up section from the wash-bowl sink upwards up to a maximum height and returns to the wash-bowl sink downwards with a down section; and a second water discharge device configured for discharging water in the form of a shower jet and including a shower jet outlet body;

wherein:

the nozzle assignment region of the first water discharge device is located in a rear half of the wash-bowl sink positioned opposite a user side and extending across at most half the sink circumference, and the shower jet outlet body of the second water discharge device is located on a rear side of the wash-bowl sink and the washstand positioned opposite the user side and on a height level above the wash-bowl sink and the washstand, and the second water discharge device is configured for discharging the shower jet in a shower jet direction pointing obliquely to the front downwards.

2. The washing place arrangement according to claim 1, wherein the first and the second water discharge devices are configured to have the shower jet striking the fountain jet in the up section of the fountain jet.

3. The washing place arrangement according to claim 1, wherein the first and the second water discharge devices are configured to have the shower jet striking the fountain jet in a height that is at least one quarter of the maximum height of the fountain jet above the wash-bowl sink.

4. The washing place arrangement according to claim 1, wherein the height level of the shower jet outlet body of the second water discharge device is located at or above half the maximum height of the fountain jet above the wash-bowl sink.

5. The washing place arrangement according to claim 1, wherein the water discharge nozzles of the first water discharge device are misting/fine jet nozzles.

6. The washing place arrangement according to claim 1, wherein the shower jet outlet body of the second water discharge device comprises fine/needle jet nozzles.

7. The washing place arrangement according to claim 1, further comprising a wall-mounted accommodation body in which the shower jet outlet body is accommodated.

8. The washing place arrangement according to claim 7, wherein the accommodation body is a placement body having a top-sided placement surface.

9. The washing place arrangement according to claim 7, further comprising a wall-mounted mirror, wherein the accommodation body is located at least with a section including the shower jet outlet body in front of the mirror and adjoins the mirror.

10. The washing place arrangement according to claim 1, further comprising a third water discharge device which is configured for discharging water in the form of a laminar jet in a laminar jet direction pointing obliquely to the front downwards and comprises a laminar jet outlet body.

11. The washing place arrangement according to claim 10, wherein an angle difference of the laminar jet direction and the shower jet direction is at most 15°.

12. The washing place arrangement according to claim 10, wherein the laminar jet outlet body is accommodated in the accommodation body.

* * * * *